United States Patent [19]

Robinson

[11] Patent Number: 4,927,569

[45] Date of Patent: May 22, 1990

[54] CARBONATION APPARATUS WITH $CO_2$ INJECTION INTO SERVING VESSEL

[76] Inventor: Bruce R. Robinson, 458 Batts Neck Rd., Stevensville, Md. 21401

[21] Appl. No.: 317,628

[22] Filed: Mar. 1, 1989

[51] Int. Cl.[5] ..... B01F 3/04

[52] U.S. Cl. ..... 261/79.2; 261/124; 261/DIG. 7

[58] Field of Search ..... 261/124, DIG. 7, 79.2

[56] References Cited

U.S. PATENT DOCUMENTS

| | | | |
|---|---|---|---|
| 953,960 | 4/1910 | Koppers | 261/124 |
| 1,655,816 | 10/1928 | Josephson . | |
| 1,767,324 | 6/1930 | Tasker | 261/124 |
| 1,958,938 | 5/1934 | Bohandy | 261/124 |
| 2,521,334 | 9/1950 | Boerstra | 261/124 |
| 2,682,827 | 7/1954 | Greesly | 261/124 |
| 2,805,846 | 9/1957 | Dewan | 261/121 |
| 2,822,157 | 2/1958 | Porter | 261/124 |
| 3,810,415 | 5/1974 | MacManus | 261/124 |
| 3,987,133 | 10/1976 | Andra | 261/124 |
| 4,045,525 | 8/1977 | Huggins | 261/124 |
| 4,222,972 | 9/1980 | Caldwell | 261/121 R |
| 4,481,986 | 11/1984 | Meyers | 261/DIG. 7 |
| 4,785,724 | 11/1988 | Vassallo | 261/124 |

*Primary Examiner*—Tim Miles

*Attorney, Agent, or Firm*—Robert P. Cogan

[57] ABSTRACT

An $CO_2$ injection nozzle is incorporated in a system for carbonating a beverage in a sealed vessel from which it will be served, such as a soda bottle. The nozzle projects vertically, and is received into and through a vessel closure member on an inverted vessel. The nozzle provides a path for communication of the vessel interior with a source of $CO_2$. A first axial portion of the nozzle is formed to provide for extension through the closure member and into liquid in the vessel. Outlet means are provided adjacent an axial extremity of the nozzle for projecting $CO_2$ for maximum path length through the liquid as it rises. The outlet means may comprise radially opposed pairs of horizontal bores extending tangentially from a vertical internal bore in the nozzle.

8 Claims, 1 Drawing Sheet

CARBONATION APPARATUS WITH $CO_2$ INJECTION INTO SERVING VESSEL

BACKGROUND OF THE INVENTION

The present invention relates to apparatus for carbonating liquids and more particularly to carbonating a beverage in a container from which it will be served.

Home carbonation apparatus is well-known in the art. They come in many different forms. A common characteristic of home carbonation systems, as this term is used in the present specification, is that liquid is introduced into a vessel from which it will be served and carbonated in that vessel. Such serving vessels comprise types of containers most commonly known as seltzer bottles and soda bottles. Vessels are distinguished from dispensers in the present description in that a dispenser is normally stationary and kept in the same place and spatial orientation whether in the process of storing or dispensing. Home carbonation implies that the vessel in which liquid being carbonated is of a conveniently handled size corresponding to common nominal sizes in which carbonated beverages for providing multiple servings are usually sold. These sizes range primarily from 28 fluid ounces to one liter (33.4 fluid ounces).

Simpler forms of home carbonation apparatus use the well-known single charge $CO_2$ gas cartridge commonly available in hardware stores having a tube of $CO_2$ closed in a tube with a puncturable metal seal. The apparatus comprises means for holding the cartridge and for breaking the seal with a pointed end of a tube communicating with means to discharge the $CO_2$ into the vessel and then disposing of the cartridge. An example of such a system for carbonating in a soda bottle is disclosed in U.S. Pat. No. 2,805,846 to L. Dewan issued Sept. 10, 1957. Many other single charge cartridge systems have also been provided in the context of a seltzer bottle. Only one vessel full of liquid is carbonated per operation of installation in the system of a carbon dioxide source.

Increasing sophistication in home carbonation systems has led to the use of a more substantial $CO_2$ gas canister with the capacity for carbonating many vessels full, for example two hundred, of liquid. Such a container is conveniently usable at home and could weigh as little as eight pounds. Nominal dimensions are a diameter of seven inches and a height of eighteen inches. In a home apparatus using such a canister, a base is provided for individual connection of a canister thereto and for readily releasable engagement of a vessel therewith. An example of such a system in the prior art is disclosed in U.S. Pat. No. 4,481,986 issued Nov. 13, 1984.

In such a system, a $CO_2$ canister is inverted and supported to the base. Valve means communicate $CO_2$ from the canister and an inlet to a fluid path in the base. $CO_2$ outlet means are provided for injecting $CO_2$ into a vessel. Further valve means control flow from inlet to the outlet. The outlet means include a vertically disposed, hollow, needle-like nozzle opened at an upper end having a gas path along a vertical axis and allowing gas to escape at an upper end thereof into the vessel. The system uses a vessel sized for cooperation therewith. The vessel is closed with a cap particularly suited for use in the system. The cap is elastomeric and normally seals the vessel. However, it will admit to penetration thereby of the nozzle and reseal after the nozzle is withdrawn therefrom. In use, liquid is placed in the vessel which is sealed with the cap. The vessel is then inverted and brought into engagement with the system. More specifically, the cap is pressed onto the vertically extending nozzle and the vessel is lowered to be supported to the base. The nozzle extends through the cap and into the liquid. The further valve means are opened and the liquid is carbonated. Suitable pressure regulating means provide for proper pressurization. The further valve means are closed, and the vessel is removed from engagement with the system.

In such a system, it is desirable to maximize the carbonation achieved for the pressure level utilized since pressure must be limited to a level below that which can be safely handled by the vessel. Other factors that will increase carbonation are water temperature and surface contact. Water temperature cannot be lowered below the freezing point. The present invention deals with the dispersion of gas in water or other liquid in this sort of system.

SUMMARY OF THE INVENTION

It is therefore an object of the present invention to provide a means for maximizing carbonation of liquid to be carbonated in a closed vessel communicating with a $CO_2$ injection nozzle projecting through closure means on the vessel for a given pressurization of the vessel and given temperature of the liquid.

It is a further object of the present invention to provide an improved $CO_2$ injection nozzle for inclusion an an apparatus of the type described.

It is a more particular object of the present invention to provide an improved carbonation system for receiving an inverted vessel for carbonation.

Briefly stated in accordance with the present invention there is provided a $CO_2$ injection nozzle incorporated in a system for carbonating a beverage in a sealed vessel from which it will be served, such as a soda bottle. The nozzle projects vertically is received into and through a vessel closure member on an inverted vessel. The nozzle provides a path for communication of the vessel interior with a source of $CO_2$. A first axial portion of the nozzle is formed to provide for extension through the closure member and into liquid in the vessel. Outlet means are provided adjacent an axial extremity of the nozzle for projecting $CO_2$ for maximum path length through the liquid as it rises. The outlet means may comprise radially opposed pairs of horizontal bores extending tangentially from a vertical internal bore in the nozzle.

BRIEF DESCRIPTION OF THE DRAWINGS

The means by which the foregoing objects and features of invention are achieved are pointed out with particularity in the claims forming the concluding portion of the specification. The invention, both as to its organization and manner of operation, may be further understood by reference to the following description taken in connection with the following drawings.

Of the drawings.

DESCRIPTION OF THE PREFERRED EMBODIMENTS

Figure 1:
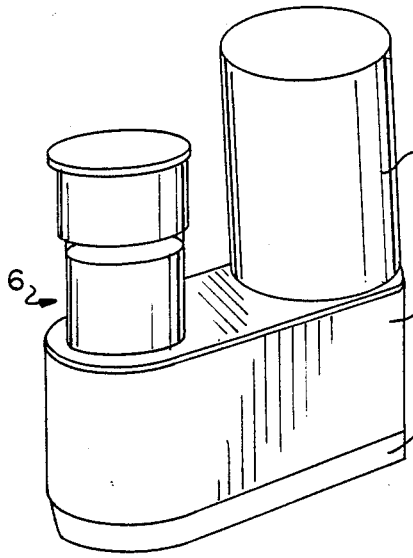
FIG. 1 is an axonometric view of a home carbonation apparatus incorporating the present invention.
Figure 2:
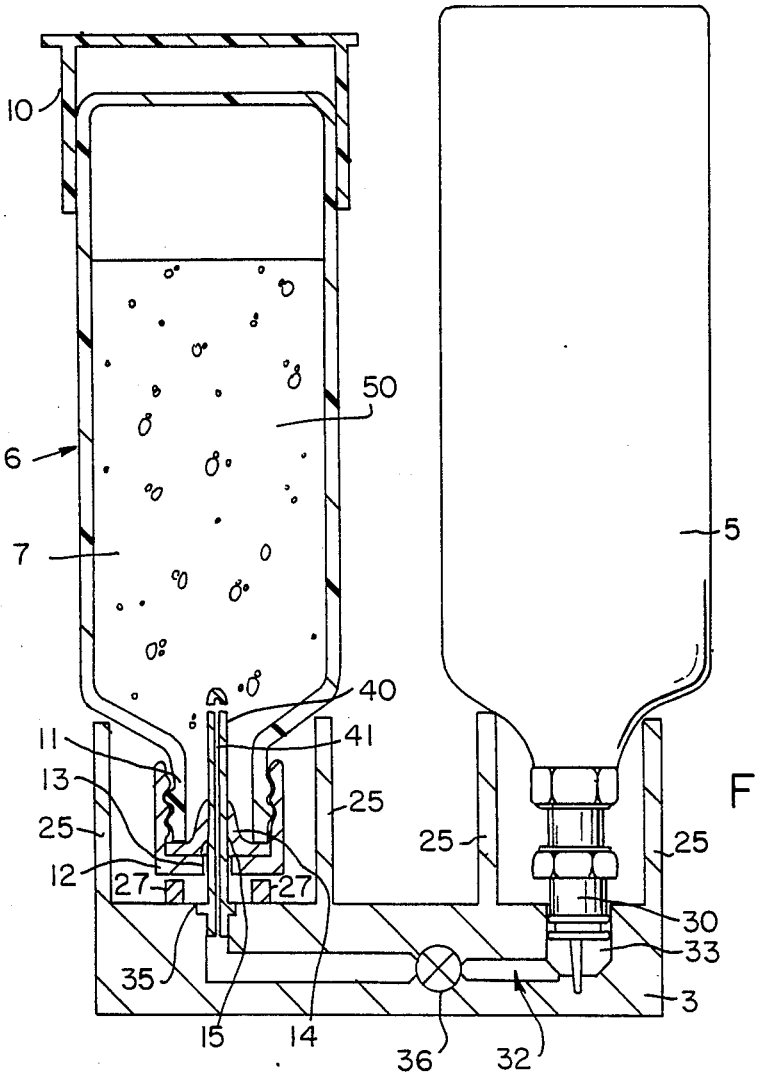
FIG. 2 is an elevation, partially in block diagrammatic form and partially in mechanical schematic form, of the apparatus of FIG. 2 with a cover removed.

FIG. 1 is an axonometric view of a carbonation apparatus 1 suitable for home use in that one container of liquid, preferably in a popular size for home consumption, is carbonated, and that same container is used for both storage in a refrigerator and for serving. FIG. 2 is an elevation of the apparatus of FIG. 1 illustrated without a cover and illustrated partially in cross-sectional and partially in mechanical schematic form. In each FIGURE, the same reference numerals are used to illustrate the same components.

In the carbonation apparatus 1, a housing 2 is supported to a base 3. The housing 2 encloses the means further described below that provide interfaces to a $CO_2$ source and to the liquid to be carbonated. A modular cover cylinder 4 fits into the housing 2 to define an enclosure for a cylinder 5 (FIG. 2) providing $CO_2$ gas. The cylinder 5 contains $CO_2$ liquid, and is configured to provide $CO_2$ gas at its output. It would be highly undesirable to provide $CO_2$ liquid into a home carbonation system due to the very high pressures which would be necessary to contain the liquid. A bottle 6, preferably plastic, is the vessel containing the liquid 7 to be carbonated, and is illustrated in an inverted position. The bottle 6 is press fit, and may also be cemented, into a cylindrical base 10 which supports the bottle 6 when it is disposed in a right-side-up vertical disposition. The bottle 6 opens at a threaded neck portion 11. The bottle 7 is closed by a removable cap 12 having an interior thread. The cap 12 has a central aperture 13 to permit penetration of nozzle means 40 described below. Elastomeric gasket means 14 are inserted in the cap 12 to provide a seal between the cap 12 and an upper surface of the neck 11. A central slit 15 in the gasket 14 permits entry of the nozzle means 40 and seals itself when the nozzle means 40 is removed.

Vertical arms 25 extending from the base 3 support the bottle 6 when it is brought into engagement with the carbonation apparatus 1. Stop means 27 mounted to the base 3 provide for limiting of movement of the cap 12 with respect to the base 3. In use, a bottle 6 is placed in the upright position with the cap 12 removed therefrom. Liquid 7 is placed in the bottle 6 which is then closed by a cap 12. The bottle 6 is inverted and inserted into the carbonation apparatus 1. Downward vertical motion is limited by movement of the cap 12 against the stop means 27. The vertical arms engage the bottle 6. Where the bottle 6 is plastic rather than glass, dimensioning of the vertical arms 25 is not critical since the surface of the bottle 6 will deform to permit vertical movement to seat the cap 12 properly on the stop means 27.

The $CO_2$ canister 5 is supported to the base 3 by further vertical support arms 25. Valve and outlet means 30 interface the $CO_2$ supply to the base 3. The base 3 comprises a gas path 32 having an input section 33 which receives the valve and outlet means 30. An outlet section 35 is provided for coupling $CO_2$ to the bottle 6 in a manner further described below. A valve 36 is provided to selectively open or close the gas path 32.

Figure 3:
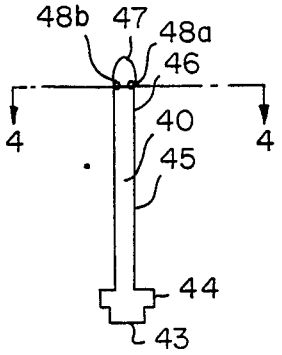
FIG. 3 is an elevation of the $CO_2$ inlet nozzle incorporated in FIG. 2.
Figure 4:
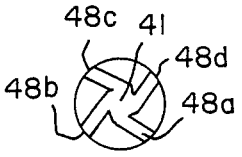
FIG. 4 is a cross-sectional view taken along lines IV—IV of FIG. 3.

Gas is coupled from the gas path 32 to be delivered from the carbonation apparatus 1 by a nozzle 40, whose disposition is illustrated in FIG. 2, and details of which are illustrated in FIGS. 3 and 4. FIG. 3 is an elevation of the nozzle 40, and FIG. 4 is a cross-sectional view taken along lines IV—IV of FIG. 3. The nozzle 40 comprises an elongated cylinder with an axial internal bore 41. The nozzle 40 is open at a lower end 43 for communication of the internal bore 41 with the output section 35 of the gas path 32. A radially enlarged exterior portion 44 is provided for swaging the nozzle 40 into a recess in the base 3. The nozzle 40 includes a first axial portion adjacent the lower end 43 which is designed to be in registration with interface means. More particularly, the portion 45 will project through the cap 12 and will extend through the slit 15 and be surrounded by the sealing gasket 14. A second axial portion 46 is farther from the lower end 43 and serves to extend the nozzle 40 into the bottle 6 beyond the narrowest portions of the neck portion 11. Prior art nozzle means are open at the upper axial end thereof. In accordance with the present invention, the nozzle 40 comprises an axial end 47 closing the gas path defined by the bore 41.

Outlet means 48 are provided communicating the $CO_2$ path from the interior of the nozzle 40 to the exterior thereof and to impart to gas exiting therefrom a horizontal component in its path. In this manner, the objective of increasing carbonation is achieved since the path length of travel of the $CO_2$ is increased compared to prior art embodiments in which the $CO_2$ exits vertically. The travel path is indicated schematically by the illustration in FIG. 1 of bubbles 50 in the liquid 7.

In FIG. 4, four outlets 48*a*, 48*b*, 48*c* and 48*d* are illustrated. In this embodiment, the outlet means 48 comprise at least first and second pairs of horizontal, radially opposed bores. The outlet means are preferably formed tangentially with respect to the bore 41. When $CO_2$ is injected into the nozzle 40, $CO_2$ passes through the bore 41 and exits the outlet means 48. The flow of $CO_2$ continues until the pressure in the bottle 6 reaches the pressure in the gas path 32 as determined by regulation means not shown which limit the pressure therein to some level less than the maximum pressure to which the canister 5 is pressurized when fully charged. A horizontal force is imparted by the reaction of the pressurized $CO_2$ against the nozzle 41 and a vertical force is applied by the buoyancy of the $CO_2$ bubbles in water. Consequently, substantially helical paths for the $CO_2$ bubbles are provided in the liquid 7.

In this manner, enhanced carbonation is provided in a home carbonation apparatus in which liquid is carbonated in a vessel from which it will be served. The above teachings have been written with a view toward enabling those skilled in the art to depart from the specifics of the preferred embodiments to provide an apparatus constructed in accordance with the present invention.

What is claimed as new and desired to be secured by Letters Patent of the United States is:

1. In a carbonation apparatus of the type comprising means for injecting $CO_2$ into liquid in an interior of an inverted serving vessel, said means including a nozzle for insertion into and through a self-sealing cap closing a lower end of said vessel, means mounting said nozzle in a vertical position in communication with a source of $CO_2$, said nozzle comprising a passage having a substantially vertically disposed axis and wherein the $CO_2$ flows through said passage in an axial direction in traveling from the source to the interior of the vessel and within the nozzle and entering the liquid substantially adjacent said cap, the improvement comprising means blocking vertical communication of said passage with the interior and wherein said nozzle further comprises at least first and second opposed $CO_2$ path means for communicating the passage to the interior of the vessel and each having an axis different from the axis of said passage, said path means being formed for imparting a force for directing injected $CO_2$ bubbles toward a helical path of travel.

2. The improvement according to claim 1 wherein said $CO_2$ entry path means comprise substantially horizontal bores communicating from said passage to the exterior of said nozzle.

3. The improvement according to claim 2 wherein said bores are formed to intersect said passage tangentially.

4. The improvement according to claim 3 wherein the axial position of said bores with respect to said passage is selected with respect to a preselected sealing cap such that when said nozzle is inserted within said cap, said bores lie a predetermined axial distance within said interior.

5. The improvement according to claim 4 wherein first and second pairs of radially opposed bores are formed in said nozzle.

6. Carbonation apparatus for receiving a container containing liquid in its interior to be carbonated by $CO_2$ bubbles traveling therethrough and rising vertically, said apparatus comprising base means for supporting the container thereto, $CO_2$ inlet means for communication for receiving $CO_2$ from a source thereof and needle means mounted in said base for insertion through a cap seal in the container when the container is supported to said base means, said needle means comprising a vertical bore for communicating said $CO_2$ inlet means to the bore within the needle and substantially horizontal passages communicating the bore to the interior of the container substantially adjacent said cap, said passages being formed for imparting a force for directing injected $CO_2$ bubbles toward a helical path of travel.

7. The apparatus according to claim 6 wherein said horizontal passages comprise at least first and second passages having radially opposed outlets.

8. The apparatus of claim 7 wherein said passages are formed tangentially with respect to said vertical bore.

* * * * *